United States Patent [19]

Kawaguchi

[11] Patent Number: 4,487,170

[45] Date of Patent: Dec. 11, 1984

[54] CARBURETOR DEVICE FOR V-TYPE INTERNAL COMBUSTION ENGINES

[75] Inventor: Yoshiyuki Kawaguchi, Niiza, Japan

[73] Assignee: Honda Giken Kogyo Kabushiki Kaisha, Tokyo, Japan

[21] Appl. No.: 421,332

[22] Filed: Sep. 22, 1982

[30] Foreign Application Priority Data

Dec. 16, 1981 [JP] Japan ..... 56-203184

[51] Int. Cl.[3] ..... F02B 75/20

[52] U.S. Cl. ..... 123/59 PC; 123/55 VF; 123/579; 123/580

[58] Field of Search ..... 123/579, 580, 55 VF, 123/59 PC

[56] References Cited

U.S. PATENT DOCUMENTS

| | | | |
|---|---|---|---|
| 1,874,401 | 8/1932 | Williams | 123/52 MV |
| 2,675,788 | 4/1954 | Porter et al. | 123/579 |
| 3,208,442 | 9/1965 | Schnegg et al. | 123/579 |
| 4,285,308 | 8/1981 | Hundertmark et al. | 123/580 |
| 4,321,978 | 3/1982 | Tominaga et al. | 123/55 VF |

FOREIGN PATENT DOCUMENTS

| | | | |
|---|---|---|---|
| 87845 | 7/1980 | Japan | 123/579 |
| 161948 | 12/1980 | Japan | 123/580 |

*Primary Examiner*—Craig R. Feinberg
*Assistant Examiner*—David A. Okonsky
*Attorney, Agent, or Firm*—Armstrong, Nikaido, Marmelstein & Kubovcik

[57] ABSTRACT

A carburetor device for V-type internal combustion engines having first and second cylinders disposed in a form like V and first and second carburetors disposed between those cylinders and adapted to supply a gaseous mixture to the associated cylinders independently. The first and second carburetors are provided with first and second intake barrels, respectively, which adjacently intersect each other and have intake passages defined therein for communication with the corresponding first and second cylinders. The carburetors further include first and second float chambers located below a point of intersection of the intake barrels with their side surfaces partially opposed to each other. In the opposed surfaces of the float chambers are opened inlets of the fuel admission ports to which inlets are fitted the opening ends of two linearly-arranged distribution pipes of a T-type joint. The T-type joint consists of the two distribution pipes and one introduction pipe joined to the distribution pipes at right angles thereto. A common fuel pipe leading to the fuel tank is connected to the introduction pipe.

8 Claims, 4 Drawing Figures

CARBURETOR DEVICE FOR V-TYPE INTERNAL COMBUSTION ENGINES

BACKGROUND OF THE INVENTION

1. Field of the Invention

This invention relates to a carburetor device for V-type internal combustion engines having first and second cylinders disposed in the V-shape, and more particularly to a carburetor device of the mentioned type in which first and second carburetors are disposed between the two cylinders and adapted to supply a gaseous mixture to the corresponding cylinders, separately.

2. Description of the Prior Art

In order to enhance the charging efficiency of an engine by utilizing the inertia effect of an intake gas, it is generally required to form an intake passage, which extends from an inlet of an intake barrel for a carburetor to an intake valve opening of the engine, as having a predetermined length and having least bent portions. However, it is very difficult to compactly form intake barrels and float chambers, which have a required capacity, for first and second carburetors in a narrow space between first and second cylinders for a V-type internal combustion engine while satisfying the above-mentioned requirements.

SUMMARY OF THE INVENTION

The present invention has therefore been proposed for overcoming the above-mentioned inconveniences of the prior art and has as its object the provision of a totally compact carburetor device of the kind mentioned, which includes first and second carburetors disposed in such a manner that their intake barrels adjacently intersect each other and float chambers for the first and second carburetors are located in a space formed between said intake barrels below the intersecting point thereof, thus satisfying the mentioned requirements and that the float chambers for those carburetors are adapted to receive fuel through a smaller number of fuel pipes to thereby simplify the piping of the pipes.

The above and other objects as well as advantageous features of the invention will become apparent from the following description of a preferred embodiment when taken in conjunction with the accompanying drawings.

DESCRIPTION OF THE PREFERRED EMBODIMENT

Figure 1:
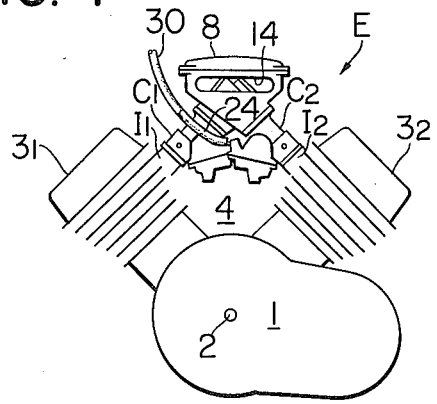
FIG. 1 is a side elevational view of a V-type internal combustion engine provided with a carburetor device embodying the present invention.

An embodiment of the present invention will now be described with reference to the accompanying drawings. Referring to FIG. 1, reference letter E denotes a V-type four-cylinder internal combustion engine to be mounted on a motorcycle. A crankshaft 2 supported on a crank case 1 for the engine E extends in the lateral direction of the vehicle. A pair of first cylinders $\mathbf{3}_1$ provided at front side of the engine E and a pair of second cylinders $\mathbf{3}_2$ provided at rear side thereof are totally arranged in the shape of the letter "V". First and second carburetors $C_1$, $C_2$, each of which comprises two carburetors constituting intake systems for the first and second cylinders $\mathbf{3}_1$, $\mathbf{3}_2$, are formed in the following manner in a V-shaped space between the first and second cylinders $\mathbf{3}_1$, $\mathbf{3}_2$. In the drawings, only one pair of first and second carburetors $C_1$, $C_2$ are shown.

Figure 2:
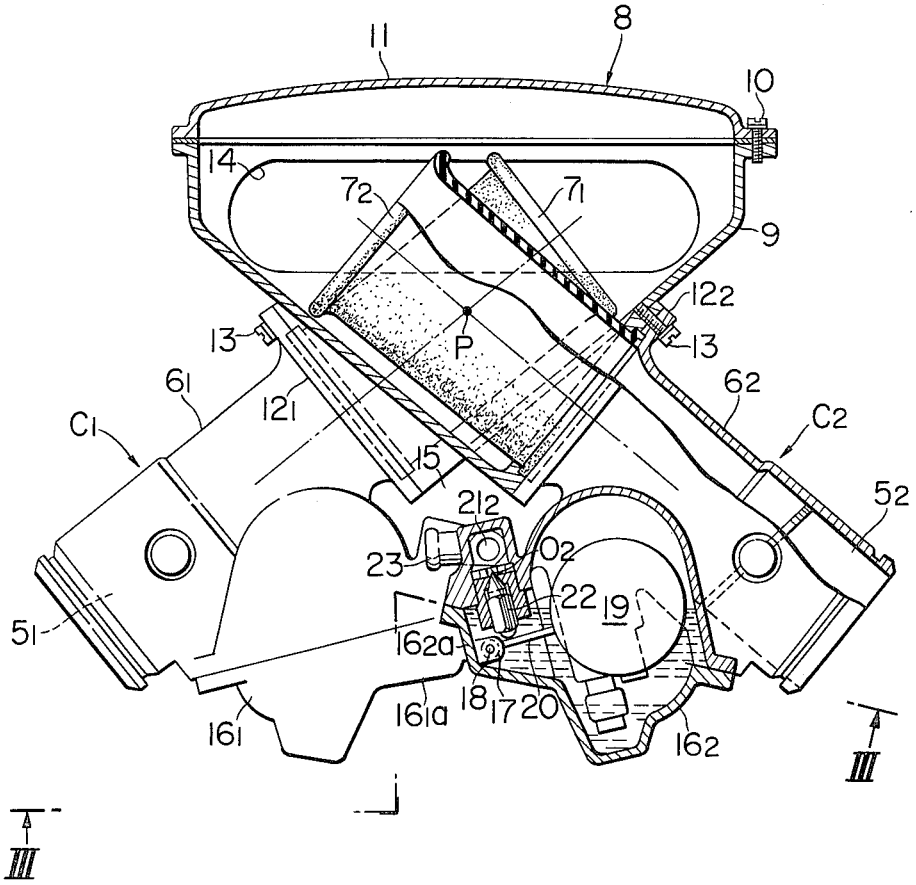
FIG. 2 is an enlarged side elevational view partially in longitudinal section of the carburetor device.

As shown in FIG. 2, the first and second carburetors $C_1$, $C_2$ have intake barrels $\mathbf{6}_1$, $\mathbf{6}_2$, respectively, which define intake passages $\mathbf{5}_1$, $\mathbf{5}_2$ therein. The carburetors $C_1$, $C_2$ are so arranged that the adjacently disposed intake barrels $\mathbf{6}_1$, $\mathbf{6}_2$ cross each other at a predetermined angle as they extend close to each other, preferably, in contact with each other. These intake barrels $\mathbf{6}_1$, $\mathbf{6}_2$ are connected to the corresponding cylinders $\mathbf{3}_1$, $\mathbf{3}_2$ via heat-insulating sleeves $I_1$, $I_2$ made of rubber or like material.

Intersecting portions of the intake barrels $\mathbf{6}_1$, $\mathbf{6}_2$ are formed with air horns $\mathbf{7}_1$, $\mathbf{7}_2$ each made of an elastic material, such as rubber. These air horns $\mathbf{7}_1$, $\mathbf{7}_2$ form substantially the shape of a triangular prism and are housed in an intake box 8 extending parallel to the crankshaft 2. The intake box 8 comprises a top-opened holder 9 and a cover 11 adapted to close the opened top of the holder 9 and fastened thereto with screws 10. Mounting flanges $\mathbf{12}_1$, $\mathbf{12}_2$ provided at intermediate portions of the intake barrels $\mathbf{6}_1$, $\mathbf{6}_2$ are fastened to the holder 9 with screws 13. Namely, all carburetors $C_1$, $C_2$ are connected unitarily to one another via the common intake box 8. The holder 9 is provided in the right and left end walls thereof with air inlets 14, into which air cleaners (not shown) are fitted.

Figure 3:
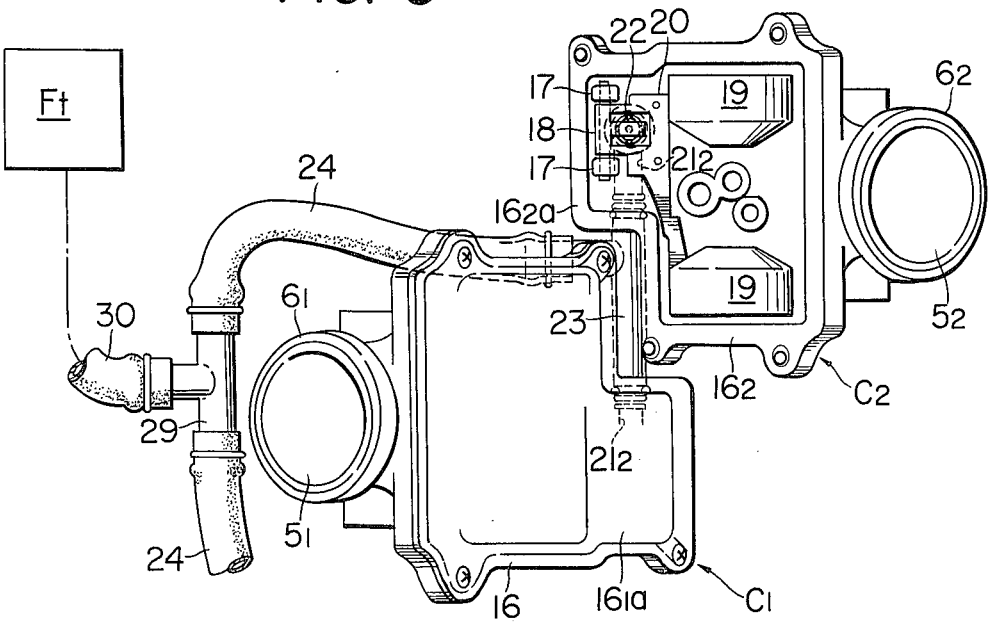
FIG. 3 is a plan view partially in horizontal section taken along the line III—III in FIG. 2.

An intersecting point P of the intake barrels $\mathbf{6}_1$, $\mathbf{6}_2$ is positioned offset from their midst portions to the inlets to provide a comparatively large space 15 below the intersecting point P and between the intake barrels $\mathbf{6}_1$, $\mathbf{6}_2$. Float chambers $\mathbf{16}_1$, $\mathbf{16}_2$ for the carburetors $C_1$, $C_2$ are disposed in a space 15. As shown in FIG. 3, the float chambers $\mathbf{16}_1$, $\mathbf{16}_2$ have extension chambers $\mathbf{16}_1$a, $\mathbf{16}_2$a additionally formed and projecting close to side surfaces of the other float chambers $\mathbf{16}_2$, $\mathbf{16}_1$, whereby the required capacities of the float chambers $\mathbf{16}_1$, $\mathbf{16}_2$ can be secured.

Each of the extension chambers $\mathbf{16}_1$a, $\mathbf{16}_2$a is provided therein with a support shaft 18 held on a pair of bearings 17 so as to extend parallel to the crankshaft 2. Each of the float chambers $\mathbf{16}_1$, $\mathbf{16}_2$ is provided therein with right and left floats 19, which are spaced from each other in the direction parallel to the support shaft 18. These floats 19 are fastened to the support shaft 18 via a pivotable arm 20 in such a manner that the floats 19 can be moved up and down in accordance with an increase and decrease in the level of the fuel oil in the float chambers $\mathbf{16}_1$, $\mathbf{16}_2$. When the arms 20 are moved pivotally in the upward or downward direction, float valves 22 provided in outlets $o_1$, $o_2$ of fuel admission ports $\mathbf{21}_1$, $\mathbf{21}_2$ for the float chambers $\mathbf{16}_1$, $\mathbf{16}_2$ are opened or closed.

The extension chambers $\mathbf{16}_1$a, $\mathbf{16}_2$a of the float chambers $\mathbf{16}_1$, $\mathbf{16}_2$ have side surfaces opposed to each other. The opposed side surfaces of the extension chambers $\mathbf{16}_1$a, $\mathbf{16}_2$a are provided with inlets $i_1$, $i_2$ formed by enlarging the fuel admission ports $\mathbf{21}_1$, $\mathbf{21}_2$. A fuel pipe 24 for both the float chambers $\mathbf{16}_1$, $\mathbf{16}_2$ is connected to the inlets $i_1$, $i_2$ via a T-type joint 23 in the following manner.

Figure 4:
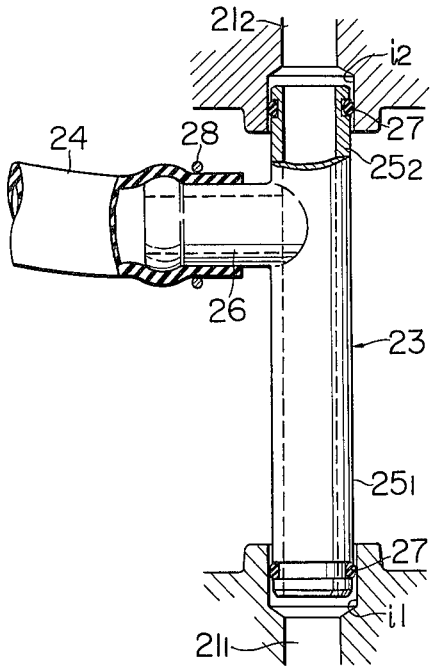
FIG. 4 is an enlarged longitudinal sectional view of a principal portion of what is shown in FIG. 3.

As shown in FIGS. 3 and 4, the T-type joint 23 consists of two linearly-arranged distribution pipes $\mathbf{25}_1$, $\mathbf{25}_2$, and one introduction pipe 26 joined to the pipes $25_1$, $25_2$ at right angles thereto, which pipes $25_1$, $25_2$, 26 are formed of a synthetic resin in an integral manner. The two distribution pipes $25_1$, $25_2$ are fitted oil-tightly into the enlarged inlets $i_1$, $i_2$ of the fuel admission ports $21_1$, $21_2$, respectively, via annular resilient seal members 27, 27 consisting of O-rings. The remaining introduction pipe 26 is provided on the outer circumferential surface thereof with a rubber fuel pipe 24 fitted elastically therearound and fixed thereto with a clip 28.

The fuel pipe 24 referred to above and the other fuel pipe 24 connected to the other pair of first and second carburetors (not shown) are connected via a T-type joint 29 to a fuel pipe 30, which is used for the two pairs of carburetors, and which is connected to a fuel tank Ft. In the case of a carburetor device for V-type 2-cylinder engines, the T-type joint 29 on the upsteam side is omitted, and the fuel pipes 24, 30 are formed integrally with each other.

When assembling this carburetor device, the distribution pipes $25_1$, $25_2$, which constitute a part of the T-type joint 23, are first fitted into the inlets $i_1$, $i_2$, respectively, of the fuel admission ports $21_1$, $21_2$ to bring the first and second carburetors $C_1$, $C_2$ close to each other. The mounting flanges $12_1$, $12_2$ of the carburetors $C_1$, $C_2$ are then joined to the holder 9 to set the air horns $7_1$, $7_2$ therein by fitting the same into the holder 9. Finally, the cover 11 is fastened to the holder 9. The crossing of the intake barrels $6_1$, $6_2$ and the fastening of the T-type joint 23 can thus be carried out easily. Moreover, it is unnecessary to specially provide a member for preventing the T-joint 23 from coming off from the fuel admission ports $21_1$, $21_2$.

In the above embodiment, the first and second carburetors $C_1$, $C_2$ have the same construction, and the shapes and sizes of the constituent parts thereof are also the same. Accordingly, when two identical carburetors are disposed so as to have the spot symmetrical relation, a carburetor device according to the present invention can be obtained.

When the fuel in the float chambers $16_1$, $16_2$ is consumed during an operation of the engine E and the oil surface lowers below a predetermined level, the floats 19 are moved down to open the float valves 22. Consequently, the fuel from the fuel tank Ft flows through the fuel pipe 30 to be distributed to the two fuel pipes 24, 24 via the T-joint 29. The fuel is further distributed from the fuel pipe 24 to the fuel admission ports $21_1$, $21_2$ in the first and second carburetors $C_1$, $C_2$ via the T-type joint 23. The fuel is thus supplied to the float chambers $16_1$, $16_2$ to compensate for the fuel consumed.

According to the present invention described above, the first and second carburetors are disposed between the first and second cylinders arranged in the shape of the letter "V", in such a manner that the intake barrels for the carburetors adjacently cross each other. Therefore, the intake barrels for the first and second carburetors, which have a predetermined length, can be provided without being bent, even in the narrow space between the first and second cylinders. This allows the inertia effect of the intake gas to be sufficiently utilized, and the output performance of the engine to be much improved.

Since the intake barrels for the first and second carburetors extend so as to cross each other, the inlets of the former are opened in the opposite directions. Accordingly, although the intake barrels are disposed close to each other, the intake gases rarely interfere with each other, so that the gaseous mixtures from the carburetors can be supplied stably to the corresponding cylinders.

Since the intake barrels are disposed close to each other, the width of the carburetor device as a whole can be reduced to be as small as possible, and the carburetor device can be compactly placed in the narrow space between the first and second cylinders.

Furthermore, the float chambers are disposed in that portion of the space between the intake barrels which is below the intersecting point thereof with the side surface of the float chambers partially opposed to each other. The fuel admission ports in the float chambers have inlets opened in the opposed surfaces thereof. A joint, which consists of two linearly-arranged distribution pipes and one introduction pipe joined to the distribution pipes at right angles thereto, which three pipes are integrally formed, is connected at its distribution pipes to the inlets provided in the opposed surfaces of the float chambers. A fuel pipe used for two pairs of carburetors and connected to the fuel tank is joined to the introduction pipe mentioned above. Therefore, the fuel can be supplied from the fuel pipe, which is connected to the fuel tank, directly into the fuel admission ports in the two float chambers. Consequently, the carburetor device according to the present invention permits halving the number of fuel pipes in use and also simplifying their piping, as compared with a carburetor device in which fuel pipes are connected to the inlets of the fuel admission ports.

The present invention is not, of course, limited to the above embodiments; it may be modified in various ways within the scope of the appended claims.

What is claimed is:

1. A carburetor device for V-type internal combustion engines, having first and second cylinders disposed in a V-shape and first and second carburetors disposed between said cylinders for supplying a gaseous mixture to said cylinders separately, comprising:

first and second intake barrels straight throughout their length, which define therein straight intake passages communicated with respective associated cylinders;

first and second straight air horns connected to the upstream opening ends of said first and second intake barrels and being colinear thereto, respectively, said first and second air horns adjacently crossing each other and extending into a common intake box;

first and second float chambers disposed in that portion of a space defined between said intake barrels which is below the crossing point of said air horns with side surfaces of said float chambers partially opposed to each other;

first and second fuel admission ports provided in peripheral walls of said first and second float chambers, respectively, and having outlets communicated with said float chambers separately and inlets opened in parts of said side surfaces of the float chambers opposed to each other;

a fuel tank;

one fuel pipe leading to said fuel tank; and a connecting means for joining said inlets of the first and second fuel admission ports to said fuel pipe.

2. A carburetor device according to claim 1, wherein said air horns are made of an elastic material such as rubber and are disposed in contact with each other at the crossing point.

3. A carburetor device according to claim 1, wherein said connecting means comprises a T-type joint having two linearly-arranged distribution pipes connected to the inlets of said first and second fuel admission ports, respectively, and one introduction pipe joined to said distribution pipes in such a manner that said distribution pipes and said introduction pipe are connected together in the shape of a letter "T".

4. A carburetor device according to claim 3, wherein each of said distribution pipes is fitted oil-tightly into one of the inlets of said fuel admission ports associated therewith, thus ensuring communication between said carburetors.

5. A carburetor device according to claim 1, wherein said first and second float chambers have extension chambers, respectively, said extension chambers projecting close to each other with each having a side surface opposed to the other.

6. A carburetor device according to claim 5, wherein float means are provided in said first and second float chambers, respectively, and support shafts for supporting said float means are provided in said respective extension chambers.

7. A carburetor device according to claim 5, wherein said inlets of the first and second admission ports are opened in said opposed side surfaces of the extension chambers.

8. A carburetor device according to any one of the preceding claims, wherein said first and second carburetors have the same construction in shape and size are disposed so as to have a spot symmetrical relation to each other.

* * * * *